US007650838B2

(12) United States Patent
Bartosch et al.

(10) Patent No.: US 7,650,838 B2
(45) Date of Patent: Jan. 26, 2010

(54) DEVICE AND METHOD FOR CONTROL OF A PRINTER OR COPIER THROUGH CONTROLLING SIGNALS

(75) Inventors: Johann Bartosch, Taufkirchen (DE); Heinrich Lay, Töging am In (DE)

(73) Assignee: Oce Printing Systems GmbH, Poing (DE)

( * ) Notice: Subject to any disclaimer, the term of this patent is extended or adjusted under 35 U.S.C. 154(b) by 451 days.

(21) Appl. No.: 11/259,559

(22) Filed: Oct. 26, 2005

(65) Prior Publication Data

US 2006/0092446 A1 May 4, 2006

(30) Foreign Application Priority Data

Oct. 29, 2004 (DE) ..... 10 2004 052 574

(51) Int. Cl.
*B41F 33/00* (2006.01)

(52) U.S. Cl. ..... 101/484; 399/395; 400/579; 400/583

(58) Field of Classification Search ..... 101/484; 399/395, 396; 400/578, 579, 583
See application file for complete search history.

(56) References Cited

U.S. PATENT DOCUMENTS

| | | | | |
|---|---|---|---|---|
| 5,172,180 | A | 12/1992 | Ohshima et al. | |
| 6,505,015 | B1 * | 1/2003 | Winter et al. | 399/66 |
| 6,826,384 | B2 * | 11/2004 | Dobbertin et al. | 399/394 |
| 2004/0013451 | A1 | 1/2004 | Fukao et al. | |
| 2006/0239699 | A1 | 10/2006 | Heimbach et al. | |

FOREIGN PATENT DOCUMENTS

| | | |
|---|---|---|
| DE | 102 50 194 | 5/2004 |
| EP | 1 496 404 | 1/2005 |

* cited by examiner

*Primary Examiner*—Judy Nguyen
*Assistant Examiner*—Matthew G Marini
(74) *Attorney, Agent, or Firm*—Schiff Hardin LLP

(57) ABSTRACT

In a method or device for control of a printer or copier, a series of discrete signal states is generated with which a drive unit for conveyance of a carrier material to be printed is controlled. A control signal is generated to end the conveyance of the carrier material. Based on the control signal, the generated series of the discrete signal states is changed at an earliest with a changed signal state following the control signal. A positioning error of the carrier material is caused due to a time period between the control signal and the changed signal state is detected.

14 Claims, 4 Drawing Sheets

DEVICE AND METHOD FOR CONTROL OF A PRINTER OR COPIER THROUGH CONTROLLING SIGNALS

BACKGROUND

The preferred embodiment concerns a method and a device for control of a printer or copier, in which a series of discrete signal states are generated with whose help a drive unit for conveying a carrier material to be printed is controlled. A control signal for ending the conveying of the carrier material is generated. The series of the discrete signal states is at the earliest changed as of the signal state change following the control signal due to the stop signal. The signal state change of the series of discrete signal states that follows the control signal is thereby generated in the series provided before the control signal. The control signal thus has an effect only after the next signal state change providing the original signal series. A reaction to the stop signal thereby only occurs as of the next signal state change. No reaction to the stop signal thus occurs in the intervening time between the control signal and the signal state change following the control signal.

In particular in the printing of web-shaped paper webs, start/stop events of the paper web in which the paper web is halted is applicable retracted and accelerated before a new transfer printing event are necessary in the generation of a plurality of print images in succession, whereby the subsequent print image is either printed congruently over a previously printed print image or bordering on a previously printed print image. If a second print image should subsequently be generated on the paper web or be generated bordering a first, previously printed print image, it is desirable that the leading edge of the second print image abuts directly on the trailing edge of the first print image. A stop event of the paper web occurs after the first print image and a start event occurs before the second printing process, in which start event the individual components of the printer or copier (such as electrophotography, paper transport, fixing station, character generator etc.) must be synchronized with one another such that the subsequent print image to be generated is correctly positioned on the paper.

The start and stop processes are controlled with the aid of a control unit. In particular what is known as a trans-run signal is generated that predetermines the start and the end of an image generation process with the aid of a character generator, such that various further control units or sub-control units of the printer or copier can be synchronized with the aid of the trans-run signal. For example, the falling edge of the trans-run signal characterizes the beginning of a print image output by the character generator, i.e. the point in time at which the character generator begins to generate the first line of a latent print image. The character generator subsequently generates a print image with n page length line-by-line on a photoconductor, for example on a photoconductor drum or on an OPC band. The latent print image generated on the photoconductor in the form of a charge image with the aid of the character generator is preferably inked with toner material into a toner image that is subsequently transferred onto a transfer band.

With the aid of the transfer band, the toner image is transported to a transfer printing location at which it is transferred onto the paper web. The time from generation of a print image line with the aid of the character generator to the transfer of this line of the print image (which line is inked with toner material) onto the paper web is dependent on the geometry and design of the respective printer, however can be determined exactly for each printer or copier. Such a line of a print image is also designated as a μ-line of the print image.

Due to the known time between generation of a line of the print image with the aid of the character generator to the transfer-printing of this line on the paper web, the paper web is time-accurately accelerated to transfer printing speed with the aid of a paper transport device or a paper conveyance device before the arrival of the first line of the print image. The contact between the transfer belt and the paper web is preferably only generated at the moment in which the first μ-line of a print image to be transfer-printed arrives at the transfer printing location. The position of the paper web is thereby controlled such that the first μ-line of the print image impacts a position of the top of a page of the paper web. This top of a page preferably lies immediately at the end of a previous print image generated on the paper web, such that the trailing edge of the previously generated print image immediately borders the μ-line of the currently generated print image.

If no further position data is supplied to the printer for at least a short time and upon generation of a plurality of color separations to be printed on top of one another in multi-color printing, the paper web must be halted for at least a short time. A rising edge of the trans-run signal signals the end of the print image output by the character generator, whereby the rising edge of the trans-run signal is generated at the moment at which the character generator has completely generated the last μ-line of the print image to be generated. Based on the rising edge of the trans-run signal, a timer is started with a predetermined time period that is required from the generation of the last print image line with the aid of the character generator to the transfer of this line inked with toner material onto the paper web.

With the expiration of the timer, a control signal is generated via which the transfer band is raised from the paper web and the conveying event is subsequently stopped. The acceleration and stoppage of the paper web occurs with the aid of what are known as acceleration ramps via which the drive unit for driving the paper web is controlled such that the paper web is essentially uniformly accelerated and uniformly braked. The paper web is essentially driven with constant speed from the point in time of the transfer of the first line of a print image to the transfer of the last line of a print image.

After the transfer printing of the last line of a print image, a uniform braking of the paper web to a stop occurs, whereby the paper web is uniformly negatively accelerated. A retraction of a paper web subsequently occurs, whereby the paper web is conveyed a preset distance counter to the conveying direction in the printing of the paper web. This distance comprises the distance conveyed after the control signal for stopping the paper web up to the standstill of the paper web and furthermore the distance required for the subsequent acceleration of the paper web during a subsequent transfer printing process for acceleration of a subsequent print image. This required distance serves to accelerate the paper web to transfer printing speed upon arrival of the first μ-line of the subsequent print image at the transfer printing location.

Positioning systems for paper webs that can only be positioned stably in discrete steps are in particular used in electrophotographic printers or copiers. These steps are, for example, half-steps given the use of step motors or decoder increments given servomotors.

Given some predetermined page lengths, the problem thereby arises that, given a print stop at the point in time at which the last μ-line has been transfer-printed onto the paper web, this does not coincide with the end or with the beginning of a discrete step of the positioning system. After a stop event in which the paper web is uniformly braked to a standstill and after the retraction of the paper web after this stop event, a false positioning of the paper web by a maximum of one step is thus possible since the paper web has been transported by a maximum of one step too far. Given the transfer printing of a subsequent print image to be generated, the desired top of the page of the paper web reaches the transfer printing location before the first line of the print image to be transfer-printed, such that a gap is created between the two print images to be generated in succession or the pages to be printed in succession.

In known printers or copiers for printing of web-shaped paper webs, the possible page length to be preset would be limited to pages in which the smallest common multiple of character generator resolution, raster precision in the controller and paper transport position raster would be formed that serves as a raster for setting a possible page length. In the following table, the determination of the raster for possible page lengths to be set is shown for two printers selected as examples.

| | Printer 1 | Printer 2 |
|---|---|---|
| Character generator resolution | 1/600 inch per μ-line | 1/600 inch per μ-line |
| Raster precision in the controller | 1/600 inch per μ-line | 1/300 or 1/600 inch per μ-line |
| Paper transport positioning raster | 1/90 inch per motor half-step | 1/120 inch per motor half-step |
| Raster for page length | 1/30 inch = 0.847 mm | 1/60 inch = 0.4235 mm |

In the prior art, the possible page lengths to be printed amount to a multiple of these determined rasters. The print images can in fact thereby be positioned exactly, however the spectrum of the selectable page lengths and thus also the application spectrum of the printer or copier is thereby limited.

The use of a step motor for driving a recording medium in an electrophotographic printer or copier is known from the document U.S. Pat. No. 5,172,180, in which different hold positions of the medium result after the generation of a color separation. For synchronization of the color separations, a position marker is provided whose position is detected with the aid of a sensor. It is thereby achieved that the position deviation of the medium comprises a half-step or one step of the step motor.

An image generation device and a method for control of the image generation device is known from the document US 2004/0013451, in which in particular three timers are provided in order to generate three different stop positions of an endless belt, i.e. of a photoconductor belt or a transfer belt.

From the subsequently published document EP 1 496 404 A1, an image generation device with a drive controller is known in which a deviation of the actual drive speed from a desired drive speed of a step motor is prevented, in particular in the acceleration of the step motor.

SUMMARY

It is an object to specify a method and a device for control of a printer or copier in which the selection possibility of page lengths to be set is not dependent on a series of discrete signal states with which a drive unit is controlled for conveying of a carrier material to be printed, and the print images are exactly positioned on the carrier material.

In a method or device for control of a printer or copier, a series of discrete signal states is generated with which a drive unit for conveyance of a carrier material to be printed is controlled. A control signal is generated to end the conveyance of the carrier material. Based on the control signal, the generated series of the discrete signal states is changed at an earliest with a changed signal state following the control signal. A positioning error of the carrier material caused due to a time period between the control signal and the changed signal state is detected.

DESCRIPTION OF THE PREFERRED EMBODIMENT

Figure 1:
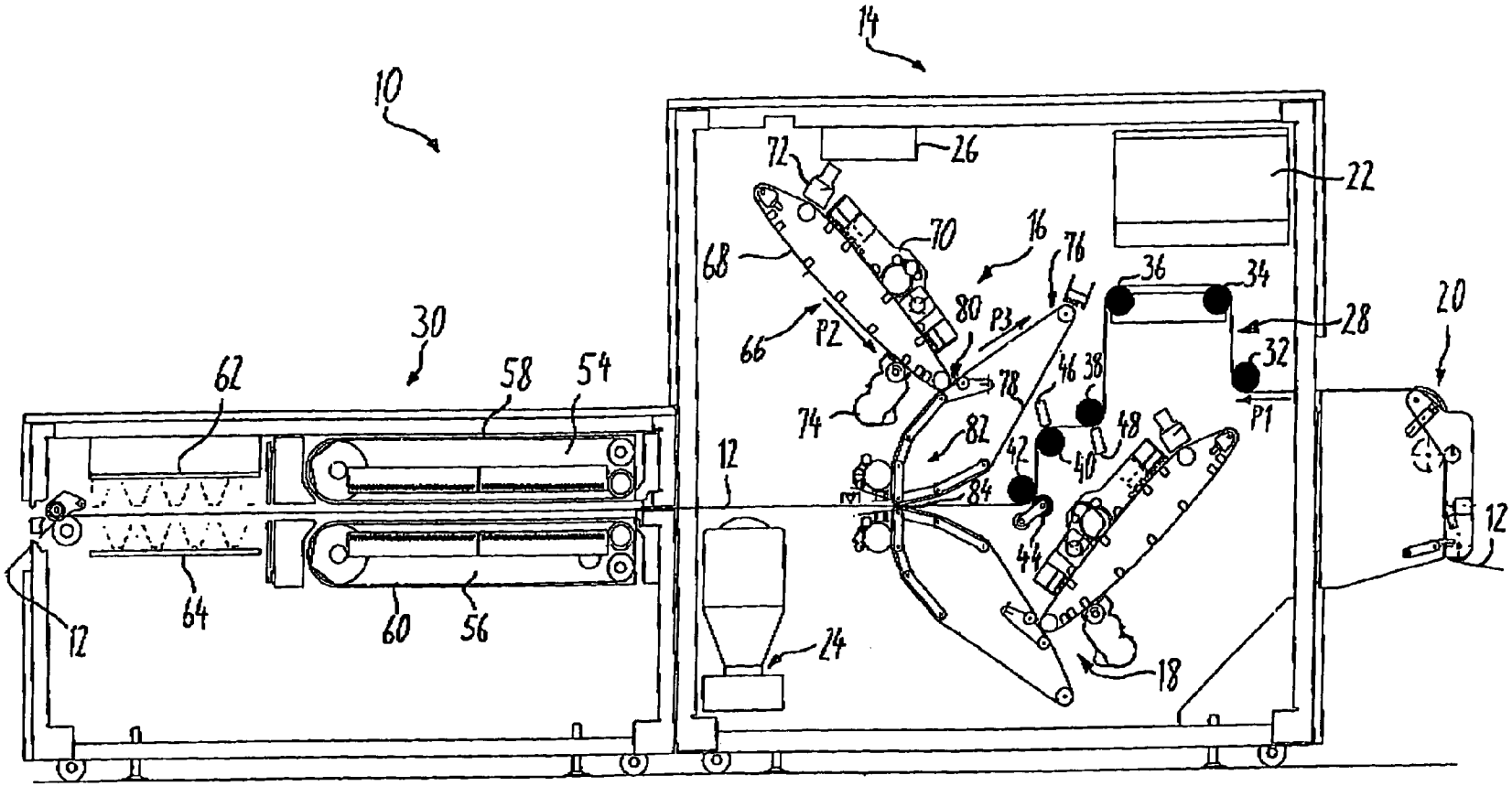
FIG. 1 is a schematic illustration of an electrophotographic printer with two printing units.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

With the preferred embodiment it is achieved that the possible positioning error of the carrier material is detected. With the aid of the detected positioning error, suitable measures can be taken in order to exactly position the subsequent toner image to be generated on the carrier material or the subsequent toner image to be transfer-printed onto the carrier material. Positioning errors such as gaps between two successive print images to be generated or between two successive pages to be generated are avoided. Possible page lengths to be preset are not dependent on the positioning steps of a drive unit for propulsion of the carrier material, whereby page lengths with an arbitrary multiple of the character generator resolution can advantageously be generated.

A second aspect of the preferred embodiment concerns a device for control of a printer or copier with a control unit that controls a series of discrete signal states to control a drive unit for conveying of a carrier material to be printed. The control unit generates a control signal to end the conveying of the carrier material. The control unit generates the signal state change following the control signal in the series provided before the control signal and changes the series of the discrete signal states at the earliest as of the signal state change following the control signal. The control unit determines a positioning error of the carrier material via the time between control signal and the change of the signal series due to the control signal.

With the aid of such a device, positioning errors of print pages to be generated in succession with the aid of a printer or copier can be detected in a simple manner, whereby suitable measures can be taken in order to remedy or to correct these positioning errors. Print images can thereby be generated with nearly arbitrary page lengths, preferably in a raster of the possible line resolution of the character generator. The application range of the printer or copier can furthermore also be significantly enlarged, since nearly any page lengths can be printed.

A third aspect of the preferred embodiment concerns a method for control of a printer or copier in which a pulse series is generated with which a step motor of a conveying device is controlled to convey a carrier material to be printed. A control signal to end the conveying of the carrier material is generated. Due to the control signal, the intervals between the pulses of the pulse series are at the earliest changed after the pulse following the control signal, whereby the pulse following the control signal is generated with the interval established before the control signal. A positioning error of the carrier material is detected via the time between the control signal and the change of the interval caused due to the control signal.

A fourth aspect of the preferred embodiment concerns a device for control of a printer or copier with a control unit that generates a pulse series that controls a step motor of a conveyance device for conveying of a carrier material to be printed. The control unit generates a control signal to end the conveying of the carrier material. The control unit changes the intervals between the pulses of the pulse series at the earliest after the pulse following the control signal and generates the pulse following the control signal at an interval with the interval provided before the control signal. The control unit detects a positioning error of the carrier material caused by the time between the control signal and the change of the interval.

An electrophotographic high-capacity printing system 10 for printing of a web-shaped paper web 12 with a print speed of approximately 1 m/s is shown in FIG. 1. A printing group 14 comprises a first image generation and transfer printing unit 16 for printing the front side of the paper web 12 as well as a second image generation and transfer printing unit 18 for printing of the back side of the paper web 12. The image generation and transfer printing units 16, 18 are designated in the following as printing units 16, 18. The printing unit 16 is essentially structurally identical to the printing unit 16. The printing group 14 furthermore comprises a paper feed 20, a control unit 22, a toner reservoir and preparation system 24, an image data processing unit 26 and a paper web drive and guidance system 28.

The paper web 12 is conveyed through the printing system 10 in the arrow direction P1 of the arrow P1 with the aid of the paper web drive and guidance system 28, whereby after the printing in the printing group 14 the paper web 12 is supplied to a fixing station 30 that fixes the toner images generated by the printing group 14 onto the paper web 12. The paper web guidance and monitoring system 28 comprises deflection rollers 32 through 40 as well as a drive roller 42 with an opposite pressure roller 44. Two hole sensors 46, 48 are also provided that monitor the position of margin holes contained in the paper web 12. A further drive roller 50 and pressure roller is provided for paper removal.

The fixing station 30 comprises a first fixing unit 54 and a second fixing unit 56 that are arranged on the opposite sides of the paper web 12, whereby the first fixing unit 54 fixes the front side and the second fixing unit 56 fixes the toner images on the back side of the paper web 12. The fixing units 54, 56 are executed as radiation fixing units, whereby the fixing units 54, 56 respectively contain sealing units 58, 60 that cover the irradiation of the fixing units 54, 56 during operating states in which no fixing of the print images on the paper web 12 should occur. Viewed in the conveying direction of the paper web 12, cooling elements 62, 64 are provided after the fixing units 54, 56, which cooling elements 62, 64 cool the paper web 12 before the exit from the fixing station 30 in order to prevent a damage to the paper web 12, in particular as a consequence of too little paper moisture.

The first printing unit 16 and the second printing unit 18 are arranged at surfaces of the paper web 12 facing away from one another. The paper web 12 can be conveyed with the aid of the drive roller 42 both in the arrow direction of the arrow P1 and in the opposite direction, whereby in the following the conveying of the paper web 12 in the arrow direction of the arrow P1 is designated with forwards movement and the conveying of the paper web 12 in the direction counter to the arrow P1 is designed with backwards movement. The function of the printing group 14 and of the fixing station 30 is described in detail in WO 00/34831 and DE 198 27 210 C1, which are incorporated herein by reference.

The first printing unit 16 comprises a first belt drive 66 with a photoconductor band 68 that is typically also designated as an OPC belt. The photoconductor band 68 is driven in the arrow direction of the arrow P2 with the aid of the belt drive 66. The photoconductor band 68 is discharged, toner residues are removed from the photoconductor band 68, and it is charged to a predetermined potential with the aid of a cleaning and charging unit 70. With the aid of a character generator 72 that is executed as an LED character generator, regions of the uniformly-charged surface of the photoconductor band 68 corresponding to the signals supplied to the character generator 72 from the image data processing unit 26 are partially (i.e. point-by-point) discharged to a lower potential or charged to a higher potential (dependent on the electrophotographic principle used), whereby a charge image is generated on the surface of the photoconductor band 68. The charge image located on the surface of the photoconductor band 68 contains a latent print image. The charge image on the surface of the photoconductor band 68 is inked with toner into a toner image with the aid of a developer unit 74.

The printing unit 16 furthermore contains a second belt drive 76 with a transfer band 78 that is driven in the arrow direction of the arrow P3. The photoconductor band 68 contacts the transfer band 78 at a transfer printing location 80, meaning that the surface of the photoconductor band 68 contacts the surface of the transfer belt 78, whereby a toner image located on the photoconductor band 68 is transferred onto the surface of the transfer band 78. With the aid of a roller device 82 whose rollers are connected with one another via levers, the transfer band 78 is advanced towards the paper web 12 and brought away from this in a transfer printing region 84, whereby the transfer band 78 in FIG. 1 is advanced towards the paper web 12. In the advanced state, the transfer band 78 contacts the surface of the paper web 12 on its front side, whereby a toner image located on the transfer band 78 is transferred from the transfer band 78 onto the front side of the paper web 12. The advancing of the transfer band 78 towards the paper web 12 is also designated as pivoting towards and bringing the transfer band 78 away from the paper web 12 is also designated as pivoting away.

As already mentioned, the printing unit 18 is essentially structurally identical with the printing unit 16, whereby a recharging unit 86 for recharging of the toner image located on the transfer band 78 is arranged on the belt drive 76 of the printing unit 16. The transfer bands of the printing unit 16 and of the printing unit 18 are essentially simultaneously pivoted towards the paper web 12, whereby a contact pressure is generated between two opposite rollers of the belt drive of the transfer bands.

The toner image on the transfer band 78 is recharged with the aid of a recharging unit 78 that is executed as a corotron arrangement. Via the recharging of the toner image on the transfer band 78, the toner particles of the toner images of the front and back side have different charges, such that the transfer of the toner images onto the paper web 12 in the transfer printing region 84 is enabled via the attraction forces between the oppositely-charged toner particles through the paper web 12.

A roller device for advancing the transfer band 78 towards or moving the transfer belt 78 away from the paper web 12 is described in detail in WO 00/54266, whose content is herewith incorporated by reference into the present specification. The transfer band 78 of the belt drive 76 is driven by the drive roller 86. The character generator 72 generates a charge image on the charged photoconductor band 68. The developer station 74 inks the photoconductor band 68 with toner material corresponding to the charge image and thus generates a toner image corresponding to the charge image. The toner image is transfer-printed from the photoconductor band 68 onto the transfer band 78 at the first transfer printing location 80. The toner image is transfer printed onto the paper web 12 at the second transfer printing location 84.

At the start of the generation of a charge image by the character generator in a first printing process, a synchronization signal "TRANSRUN" is generated that is transferred to a paper transport control unit contained in the control unit 22. The print image output is signaled by the character generator 72 with the aid of the signal "TRANSRUN". The print image output of the character generator is started with the activation of the signal "TRANSRUN" and a timer 1 contained in the paper control unit is started with the aid of a hardware circuit. Timer 1 then runs down according to a preset time and starts the conveying of the paper web 12 in the direction of the arrow P1. After the expiration of the timer 1 (not shown), the conveying of the paper web 12 begins with the acceleration of the paper web 12 to printing speed.

Upon ending the print image output with the aid of the character generator 72, the signal "TRANSRUN" is deactivated, whereby a second timer 2 contained in the paper control unit is started. The timer 2 is realized like the timer 1 with the aid of hardware components. A control signal, i.e. a stop signal, is generated with the expiration of a preset time of the timer 2. With the stop event, the paper transport control unit thereby begins to end the conveying of the paper web 12 and subsequent retraction of the paper web 12 as a preparation for a further printing process. Via these timers 1, 2, the paper transport at the start and stop of the print image output is synchronized with the further components of the printing system 10, in particular with the image generation components. The timer 1 thus determines the delay of the paper transport start event in reference to the beginning of the print image output by the character generator 72. The timer 2 determines the delay of the paper transport stop event in reference to the end of the print image output by the character generator 72.

From the German patent application with the official file number 103 38 315, it is known to start a second printing process while the timer 1 is still running, such that the character generator 72 can already begin with the generation of a second print image when the timer 1 has not yet expired. Furthermore, the second printing process can also then already be ended when the timer 2 has not expired. For this, at least one timer 3 is provided in the solutions described in this patent application, which timer 3 can already be started when timer 1 or timer 2 have not yet expired. The content of this patent application is herewith incorporated by reference into the present specification.

This timer 3 can be used at least to control the paper transport start event of the second printing process, whereby after the expiration of the timer 1 (i.e. the timer for control of the paper transport start event of the first printing process) it is available as a time for control of the paper transport stop event of the second printing process. In other exemplary embodiments described there, two timers are respectively provided for control of the paper transport start events and two timers are respectively provided for control of the paper transport stop events. In particular in printers with a longer transport part between character generator and transfer printing location 84, further timers can also be provided for control of the start and stop events of the paper transport.

Figure 2:
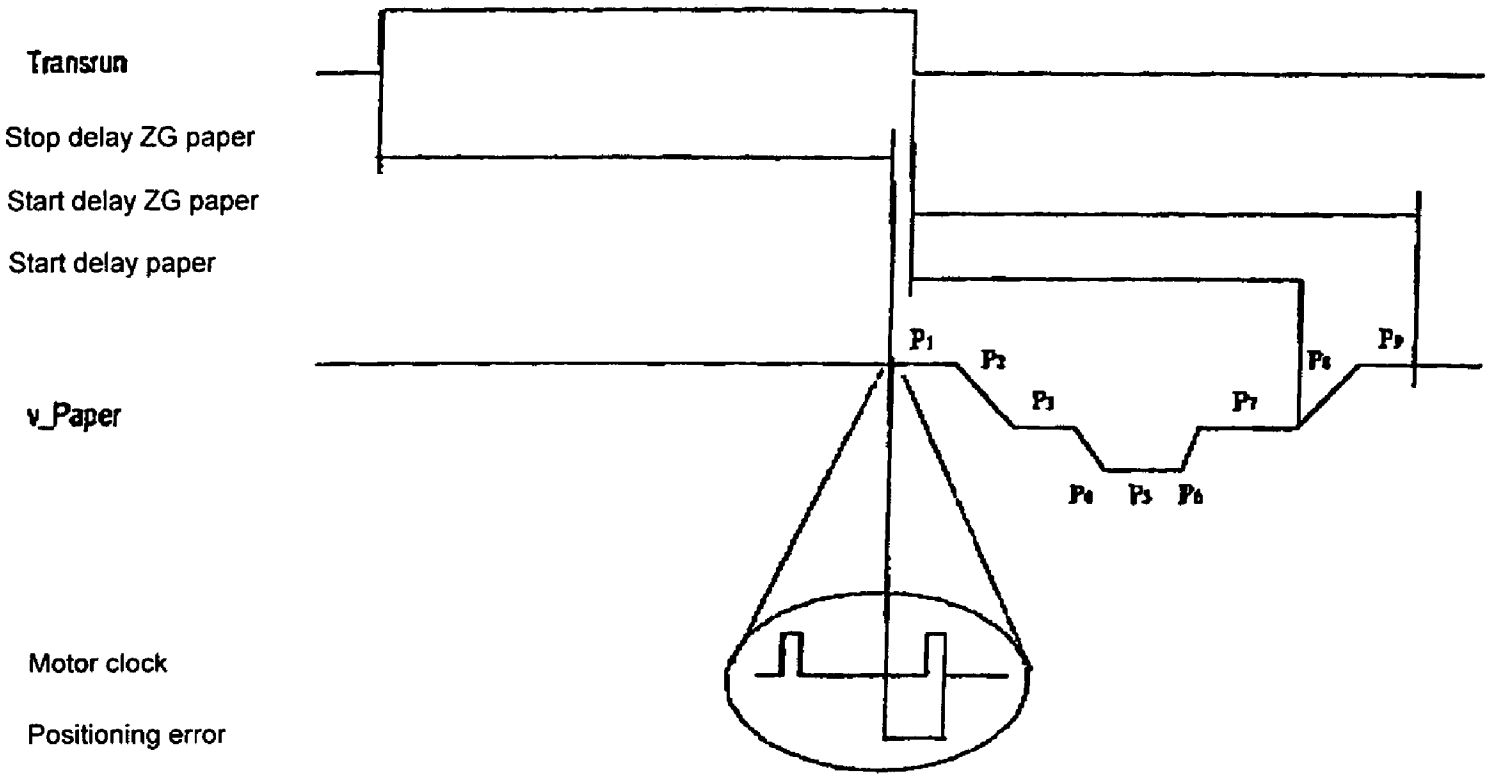
FIG. 2 is a diagram in which is shown the control of a paper web driver of the printer according to FIG. 1, dependent on a signal for activation of an image generation process according to the prior art.

In FIG. 2 a diagram is shown in which is shown the control of a paper web drive of the printing system 10 according to FIG. 1, dependent on the trans-run signal for activation of the image generation process. Identical elements have identical reference characters.

After the generation of the last μ-line of a print image with the aid of the character generator, a rising edge of the trans-run signal is generated. A timer 2 is thereby started that expires after a predetermined time "stop-delay ZG-paper". A stop signal is generated with the expiration of the timer 2. The timer 2 contains a counter that is started with the aid of the rising edge of the trans-run signal and counts a high-frequency system clock of the printing system 10 that is also designated as a main clock. After reaching or after the expiration of a preset counter state, the stop signal is then started to start or initiate the start event of the paper web.

This stop event that is initiated by this stop signal is divided up into the following phases:

Phase P1-a first number of motor steps of a step motor for actuation of the paper web 12, whereby the transfer band 78 is detached from the paper web 12 in this time period;

Phase P2-a second number of motor steps, whereby the drive speed of the paper web 12 is uniformly reduced to a stand still;

Phase P3-preset wait time, preferably 832 ms;

Phase P4-a third number of motor steps for uniform acceleration of the paper web 12 to retraction speed counter to the conveying direction in the transfer printing of print images on the paper web 12;

Phase P5-a fourth number of motor steps, whereby the paper web 12 is conveyed at a constant speed counter to the conveying direction in the transfer printing of toner images;

Phase P6-a fifth number of motor steps in which the retraction speed of the paper web 12 is uniformly reduced until a standstill of the paper web 12;

Phase P7-standstill until a timer 1 has expired after the expiration of start delay ZG and the paper web 12 is uniformly accelerated in order to transfer-print a subsequent print image on the paper web 12;

Phase P8-a sixth number of motor steps for acceleration of the paper web 12 to transfer printing speed or process speed for transfer printing of the subsequent print image; and Phase P9-a seventh number of motor steps, whereby the paper web 12 is conveyed with constant speed, whereby the transfer band 78 is pivoted towards the paper web 12 before the transfer printing begins.

The motor clock of the step motor for actuation of the paper web 12 is likewise generated with the aid of a counter of the system clock "main clock". For each half-step, 160 clock pulses of the system clock from −160 to 0 are counted upwards with the aid of a motor clock interval counter. Alternatively a counter can also be used in which a count from 0 up to a preset desired value of 160 is made. At the point in time of the expiration of the counter of the timer 2, the timer 2 outputs a stop signal and the current counter state of the motor clock interval counter is stored in a storage range, (in particular in a register) of the control unit of the printing system 10. For example, the count value is −70. The paper web 12 has thereby been transported too far by the fraction −70/−160 of a motor half step upon the printing stop, whereby a positioning error of the paper web 12 exists.

The motor clock shortly before and shortly after the occurrence of the stop signal is shown in FIG. 2 in an enlarged representation in which the stop signal occurs between two activation pulses for activation of the step motor, whereby a positioning error of the paper web 12 arises from the occurrence of the stop signal until the pulse immediately following the stop signal or the pulse edge of the following pulse. The positioning error is likewise shown below the motor clock pulse in the enlarged representation.

This positioning error can be detected with the aid of the motor clock counter, whereby the start point in time is corrected in the subsequent printing event, i.e. in the generation of a subsequent print image, and the positioning error is thereby compensated. The start event is preferably started later by a period of time that was determined to have advanced too long at the start. In the subsequent example, it is shown how the count value of the timer 1 is changed at the start of a new printing event (start delay ZG paper) dependent on the determined positioning error.

EXAMPLE

Start delay *ZG* paper (normal) =

1350000 main clock pulses (corresponds to 2.4 seconds at 562500 *HZ*)

Start time paper (phase *P*8 and *P*9) = 147939 main clock pulses

Start delay paper (normal) =

(1350000 − 147939) main clock pulses = 1202063 main clock pulses

Measured positioning errors at the last stop = −70 main clock pulses

Start delay paper (with correction) = (1202063 − (−70))

main clock pulses = 1202133 main clock pulses

Both the timer and the control unit for generation of a stop signal and for activation of the step motor for driving the paper web 12 can be realized as hardware and/or as software. The start, stop and motor clock interval counters have preset count values that can preferably be adjusted with the aid of an operating unit. The correction of the determined positioning error is preferably corrected with the aid of an alteration of the start time for conveying of the paper web 12 given a subsequent printing process.

Figure 3:
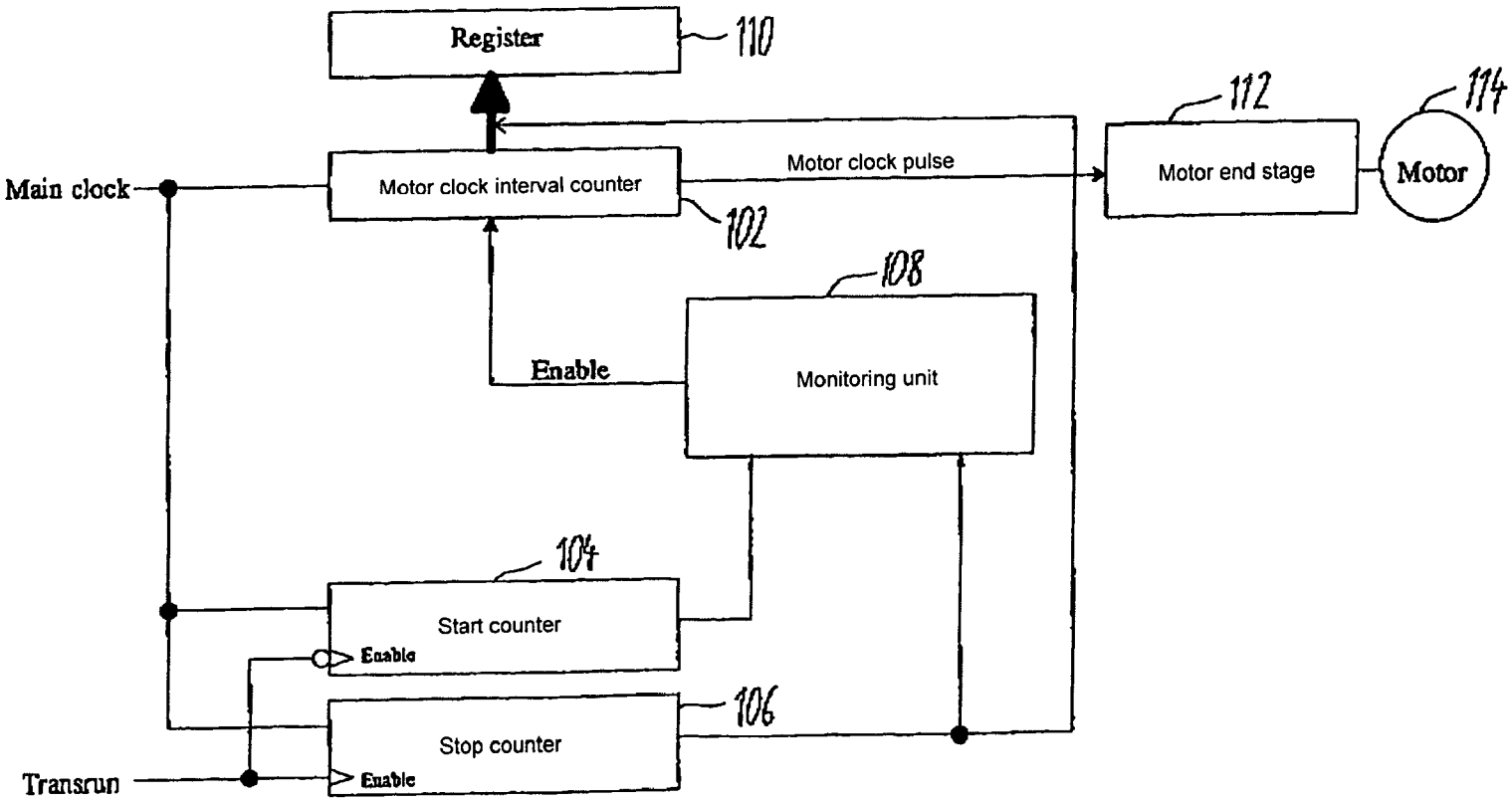
FIG. 3 is a block diagram of the components of the control unit according to FIG. 1 to control the printing process according to the diagram of FIG. 2.

Shown in FIG. 3 is a block diagram for control of the printing system according to FIG. 1 via which a positioning error of the paper web 12 according to FIG. 2 can be detected and corrected. The control unit comprises a motor clock interval counter 102, a start counter 104 and a stop counter 106. The trans-run signal is supplied both to the start counter 104 and to the stop counter 106. The system clock pulse (main clock pulse) is supplied to the motor clock interval counter 102, the start counter 104 and the stop counter 106. The outputs of the start counter and of the stop counter are supplied to a monitoring unit 108. After the expiration of the stop counter, the monitoring unit 108 reads the current counter state of the motor clock interval counter 102 and stores this count value in the register 110. The motor clock interval counter 102 outputs a motor clock pulse at the motor end stage 112 that activates a step motor 114 for actuation of the paper web 12.

Figure 4:
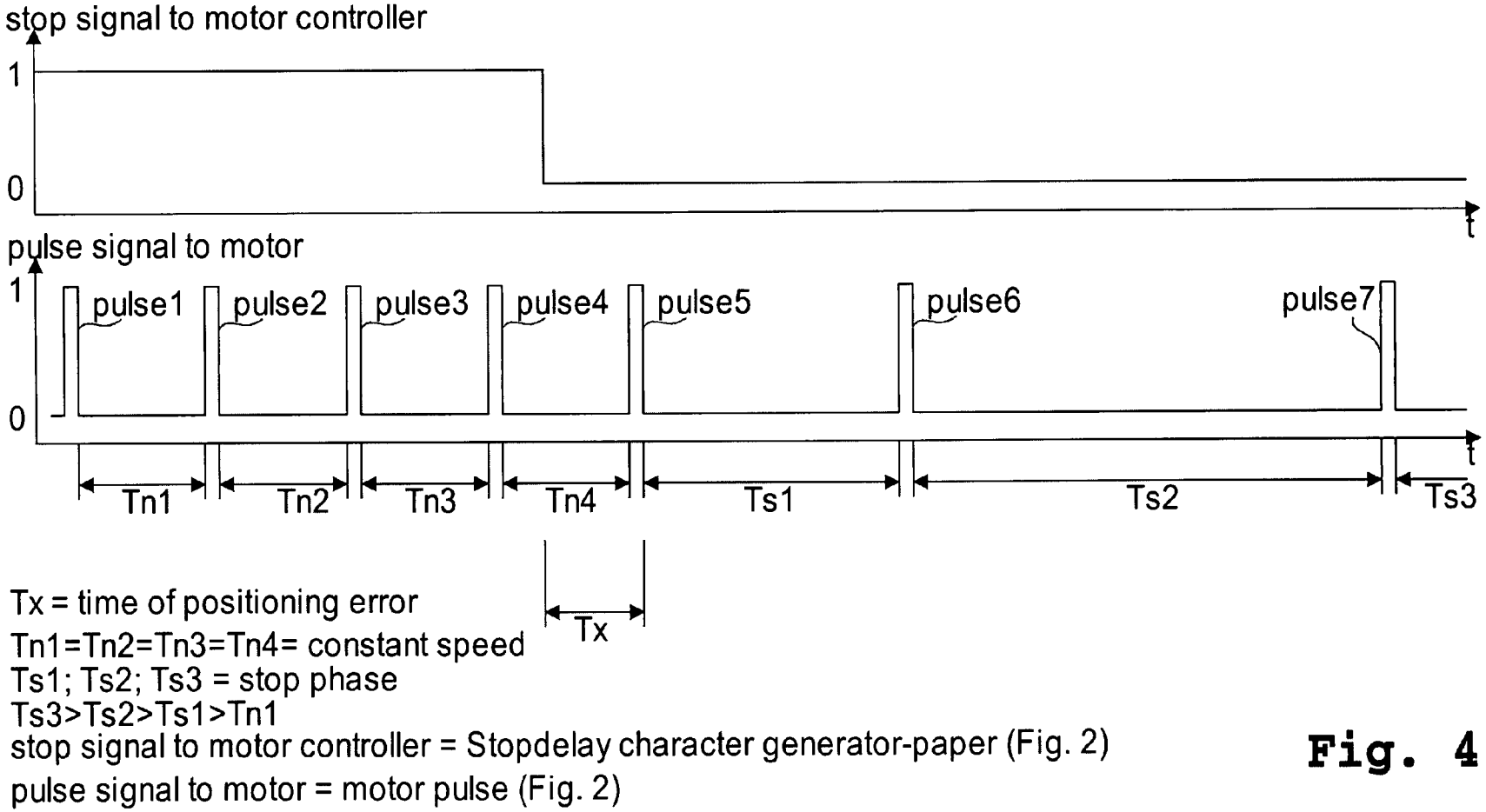
FIG. 4 is a timing diagram of the stop signal and pulse signals to the motor.

As a supplement to FIG. 2, FIG. 4 also shows the stop signal to the motor controller and more specifically shows the pulse signals to the motor occurring before and after initiation of the stop signal. As shown FIG. 4, a plurality of discrete signal states Tn1, Tn2, Tn3, and Tn4 are provided of equal length. After the stop signal occurs, a pulse5 occurs so that the signal state Tn4 with a same length still occurs despite the stop signal. Thereafter, a changed signal state occurs as shown with progressively longer changed signal states Ts1, Ts2, and Ts3. As illustrated, the stop signal occurs between pulse4 and pulse5. The increase in signal states Ts1, Ts2, and Ts3 depends on the desired or preset breaking or stop curve.

In FIG. 4, the positioning error occurs between the occurrence of the stop signal to the motor controller until the end of the subsequent pulse5. This is represented by Tx in FIG. 4.

In FIG. 2, the signal "stopdelay ZG paper" is designated "stop signal to motor controller" in FIG. 4. The signal "motor clock" in FIG. 2 is designated "pulse signal to motor" in FIG. 4. Finally, the signal "positioning error" of FIG. 2 is designated "time of positioning error" in FIG. 4.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A method for control of a printer or copier, comprising the steps of:

generating a series of discrete signal states each having a first time duration with which a drive unit for conveyance of a carrier material to be printed is controlled;

generating a control signal which is independent of said discrete signal states for conveyance of said carrier material to end the conveyance of the carrier material;

based on the control signal, changing the generated series of discrete signal states at an earliest with a changed signal state having a second time duration different than the first time duration following the control signal; and detecting a positioning error of the carrier material caused due to a time period between a beginning of the control signal and a beginning of the changed signal state.

2. A method of claim 1 wherein the signal states are defined by pulses at the beginning and end of each of the signal states.

3. A method according to claim 1 wherein the positioning error is generated at an end of a first printing process for generation of a first print image, and dependent on the detected positioning error, a start point in time is varied for conveyance of the carrier material for generation of a second print image during a second printing process or via a variation of a start point in time for generation of the second print image to be transfer-printed on the carrier material such that the carrier material is correctly positioned upon transfer printing of the second print image.

4. A method according to claim 3 wherein to determine the positioning error, a time period between a generation of the control signal and the beginning of observation of the control signal is detected whereby the start point in time for conveying the carrier material for generation of the second print image is started later for position correction, or whereby the start point in time of the generation of the second print image to be transfer-printed onto the carrier material is started earlier.

5. A method according to claim 4 wherein the start point in time for conveying the carrier material is started later by the detected time period, or the start point in time for generation of the second print image to be transfer-printed on the carrier material is started earlier by the detected time period.

6. A method according to claim 1 wherein a first control signal is generated via which a timer is started with a preset expiration time, a second control signal is generated after expiration of the timer, the positioning error being determined starting from the second control signal.

7. A method according to claim 1 wherein the time period is determined with aid of a clock signal and a counter, the counter counting clock pulses of a system clock between the control signal and an end of a current signal state.

8. A method according to claim 1 wherein the carrier material is a web-shaped carrier material on which a plurality of print images are generated in successive printing processes, the print images being preferably generated in succession and bordering one another on the carrier material.

9. A method according to claim 1 wherein the control signal is generated at a point in time at which a trailing edge of a print image to be transfer-printed onto the carrier material is transfer-printed onto the carrier material.

10. A method according to claim 1 wherein due to the control signal after an end of a current signal state or a further subsequent signal state, a drive speed of the carrier material is reduced in a ramping manner until a standstill of the carrier material.

11. A method according to claim 10 where the carrier material is conveyed by a preset distance counter to a transfer printing conveyance direction after a standstill and before transfer printing of a subsequent print image to be transfer-printed on the carrier material, said distance preferably corresponding to a sum of a conveyed distance from an end of the conveying step until the standstill of the carrier material and a distance for acceleration of the carrier material from the standstill to transfer printing speed before the transfer-printing of the subsequent print image to be transfer-printed.

12. A method according to claim 11 wherein the determined positioning error is corrected upon retraction of the carrier material.

13. A method according to claim 1 wherein a length of a print image corresponds to a length of a print page to be generated or to a form length.

14. A device for controlling a printer or copier, comprising:

a control unit that generates a series of discrete signal states each having a first time duration that control a drive unit for conveying a carrier material to be printed;

the control unit generating a control signal which is independent of said discrete signal states for conveyance of said carrier material to end the conveyance of the carrier material;

the control unit generating a changed signal state having a second time duration different than the first time duration following the control signal to change the generated series of discrete signal states; and the control unit detecting a positioning error of the carrier material caused due to a time period between a beginning of the control signal and a beginning of the changed signal state.

* * * * *